US005966928A

United States Patent [19]

Igarashi

[11] Patent Number: 5,966,928

[45] Date of Patent: Oct. 19, 1999

[54] PARTICULATE INCINERATING METHOD AND MECHANISM FOR EXHAUST BLACK SMOKE REMOVING SYSTEM

[75] Inventor: Tatsuki Igarashi, Tokyo, Japan

[73] Assignee: Hino Motors, Ltd., Tokyo, Japan

[21] Appl. No.: 08/856,304

[22] Filed: May 14, 1997

[30] Foreign Application Priority Data

May 24, 1996 [JP] Japan ..... 8-130013

[51] Int. Cl.[6] ..... F01N 3/02

[52] U.S. Cl. ..... 60/274; 60/303; 60/311; 55/431

[58] Field of Search ..... 60/295, 297, 303, 60/274; 55/430, 431

[56] References Cited

U.S. PATENT DOCUMENTS

| | | | |
|---|---|---|---|
| 3,383,854 | 5/1968 | White | 60/295 X |
| 4,506,506 | 3/1985 | Usui et al. | 60/303 |
| 4,549,399 | 10/1985 | Usui et al. | 60/303 X |
| 4,693,078 | 9/1987 | Dettling et al. | 60/303 X |
| 4,833,883 | 5/1989 | Oda et al. | 60/303 X |
| 4,858,431 | 8/1989 | Leonhard et al. | 60/303 X |
| 4,867,768 | 9/1989 | Wagner et al. | 60/311 X |
| 4,874,407 | 10/1989 | Lefkowitz | 60/311 |
| 4,875,335 | 10/1989 | Arai et al. | 60/311 X |
| 5,390,492 | 2/1995 | Levendis | 60/311 X |

FOREIGN PATENT DOCUMENTS

| | | |
|---|---|---|
| 407332070 | 12/1995 | Japan . |
| 409273414 | 10/1997 | Japan . |

*Primary Examiner*—John E. Ryznic
*Attorney, Agent, or Firm*—McCormick, Paulding & Huber

[57] ABSTRACT

A power-saving and long-life particulate incinerating mechanism for use in a reverse-cleaning regenerative exhaust black smoke removing system. Also disclosed is a particulate incinerating method therefor. A hopper has a bottom portion and slant portions made of a heat-insulating material. An air pipe having a large number of small holes extends substantially along the hopper bottom. A heater extends above the air pipe in parallel to it. The small holes of the air pipe are formed such that air can be jetted out from the small holes toward the heater. A relatively small quantity of particulate burning assist air is always supplied from the small holes of the air pipe, and a relatively large quantity of purging air is substantially periodically supplied from the small holes.

4 Claims, 3 Drawing Sheets

PARTICULATE INCINERATING METHOD AND MECHANISM FOR EXHAUST BLACK SMOKE REMOVING SYSTEM

BACKGROUND OF THE INVENTION

The present invention relates to a particulate incinerating method and mechanism for use in a reverse-cleaning regenerative exhaust black smoke removing system for diesel engines. More particularly, the present invention relates to a particulate incinerating method and mechanism wherein the power consumption is minimal and a heater for ignition has a long lifetime.

There have been proposed various exhaust black smoke removing systems using a gas-permeable porous filter for trapping and incinerating particulates (soot) in exhaust gas discharged from diesel engines. FIG. 1 is a schematic view for describing the principle of a cross-flow filter for trapping particulates in exhaust gas. The cross-flow filter is known, for example, from JP-B2-5-63604 (Japanese Patent Publication No. 5-63604).

The cross-flow filter as shown in FIG. 1 has a filter consisting essentially of a multiplicity of rectangular filter plates 11 made of a gas-permeable porous ceramic material having a filter function, which are stacked in a rectangular parallelepiped configuration. Each filter plate 11 has a first passage 14 formed from a large number of through-holes 15, both ends of which are open. Each pair of adjacent filter plates 11 are separated from each other by spacers 22 to define a thin rectangular parallelepiped-shaped second passage 24 between the two filter plates 11.

Exhaust gas containing particulates, which is discharged from a diesel engine, is introduced into the first passages 14 from openings provided in inlet surfaces 12, as shown by the arrow E in FIG. 1. The exhaust gas is prevented from flowing out from particulate discharge surfaces 13. Consequently, the exhaust gas passes through the gas-permeable porous ceramic material constituting the filter plates 11 and further passes through the second passages 24 to flow out from gas outlet surfaces 23. Particulates of large diameter in the exhaust gas cannot pass through the ceramic material; therefore, these particulates are deposited on the wall surfaces of the first passages 14 and thus removed from the exhaust gas, and only dedusted exhaust gas H is discharged from the gas outlet surfaces 23. After exhaust gas has been passed through the first and second passages 14 and 24 for a predetermined period of time, cleaning air is passed for a short period of time (momentarily) in a direction reverse to the flow direction of exhaust gas, that is, from the second passages 24 to the first passages 14 through the gas-permeable porous material, thereby removing the deposited particulates from the wall surfaces of the first passages 14, and thus regenerating the filter by reverse cleaning. The particulates removed from the wall surfaces drop through the first passages 14 by gravity, as shown by the arrow P in FIG. 1, and enter a hopper (not shown) under the particulate discharge surfaces 13. The particulates are incinerated in the hopper.

FIG. 2 is a plan view schematically showing a conventional exhaust black smoke removing system using the filter shown in FIG. 1. In the system shown in FIG. 2, dust-containing exhaust gas E discharged from a diesel engine G enters an inlet chamber 62 through an exhaust inlet pipe 57. In the inlet chamber 62, the exhaust gas E is guided to the inlet surface 12 of the filter 10 and passed through the filter 10 to remove particulates therefrom, thus becoming dedusted exhaust gas H, which is then discharged through an exhaust outlet pipe 58, an exhaust valve 92, etc.

In the conventional exhaust black smoke removing system shown in FIG. 2, reverse cleaning of the filter 10 is carried out under control of a controller C as follows: After dust-containing exhaust gas E has been passed through the filter 10 for a predetermined period of time, a solenoid valve 93 is opened to allow compressed air of 6–8 kg/cm$^2$ to be supplied from an air tank S to an actuator 94, causing the actuator 94 to close an exhaust valve 92. At substantially the same time as the exhaust valve 92 is closed, a solenoid valve 84 provided in an air pipe 82 for providing communication between the air tank S and an air nozzle 75 opening into the exhaust outlet pipe 58 is opened for a short period of time to allow compressed air to be jetted into the exhaust outlet pipe 58 through the solenoid valve 84 and an air nozzle 75. The compressed air flows through a path reverse to that of exhaust gas. That is, the air passes through the second passages of the filter 10 and further passes through the gas-permeable porous material to enter the first passages, thereby removing deposited particulates from the peripheral wall surfaces of the first passages in cooperation with the effect of pressure waves produced from the air nozzle 75, and allowing the removed particulates to drop into a hopper 68 through the particulate discharge surface 13. Thus, the filter 10 is regenerated by reverse cleaning.

Particulates dropping into the hopper 68 are incinerated by heat from an ignition heater 66 provided in the hopper 68. The ignition heater 66 is heated by electric power supplied from a battery V. This type of exhaust black smoke removing system is known from JP-B2-5-63604 (Japanese Patent Publication No. 5-63604) and JP-U-5-58812 (Japanese Utility Model Public Disclosure No. 5-58812). In order to avoid interference with the overall discharge of exhaust gas from the diesel engine during the filter reverse cleaning process, there are provided two parallel systems each consisting essentially of the filter 10, the exhaust valve 92, the hopper 68, etc., and the two systems are alternately subjected to reverse cleaning process, thereby allowing either of the exhaust outlet pipes 58 to be open at all times.

In the conventional reverse-cleaning regenerative exhaust black smoke removing system shown in FIGS. 1 and 2. particulates are incinerated in a hopper disposed away from the filter. Therefor, the heat of incineration of particulates is not directly applied to the filter, and thus no heat load is imposed on the filter. Moreover, ash resulting from the incineration of particulates will not accumulate in the filter; this enables the filter lifetime to be increased. However, systems to be mounted on vehicle are generally demanded to save electric power and to reduce costs. Therefore, a relatively low-cost heater is used for ignition of particulates, and because the ignition heater is buried in particulates, it is likely to overheat. Accordingly, the lifetime of the heater is unfavorably short.

SUMMARY OF THE INVENTION

An object of the present invention is to provide a hopper for particulate incineration in a reverse-cleaning regenerative exhaust black smoke removing system, the hopper having an ignition heater of long lifetime which enables particulates to be incinerated with minimal electric power, thereby improving the disadvantages of the conventional reverse-cleaning regenerative exhaust black smoke removing system.

Another object of the present invention is to provide a burning assist air supply mechanism wherein burning assist air is effectively supplied to promote incineration of particulates, and nozzle holes of an air pipe for supplying burning assist air are prevented from clogging.

Still another object of the present invention is to promote incineration of particulates and to improve the efficiency of an ignition heater by periodically removing particulate incineration ash from around the heater.

A further object of the present invention is to improve the efficiency of an ignition heater by controlling an electric current supplied to the heater.

Other objects and advantages of the present invention will become apparent from the following description.

(Means for Solving the Problems)

In a particulate incinerating method and mechanism for an exhaust black smoke removing system according to the present invention, a filter made of a gas-permeable porous material has a plurality of first passages extending from an inlet surface, and a plurality of second passages extending between the first passages and opening on an outlet surface. Exhaust gas discharged from a diesel engine flows successively through the filter inlet surface, the first passages, the gas-permeable porous material lying between the first and second passages, the second passages, and the outlet surface. Consequently, particulates in the exhaust gas are deposited on the wall surfaces of the first passages. Cleaning air is supplied to flow in a direction reverse to the flow direction of the exhaust gas, thereby removing the deposited particulates from the wall surfaces of the first passages and allowing the removed particulates to drop into a hopper where they are incinerated by heat from a heater for ignition, and thus regenerating the filter.

In the particulate incinerating method according to the present invention, the hopper has a bottom made of a heat-insulating material. The bottom of the hopper has an elongate deep bottom portion and slant portions sloping upward from the deep bottom portion. An air pipe having a large number of small holes is provided to extend substantially along the hopper bottom. The heater is provided to extend above the air pipe in parallel to it. The small holes of the air pipe are formed such that air can be jetted out from the small holes toward the heater. A relatively small quantity of particulate burning assist air is always supplied to the air pipe, and a relatively large quantity of purging air is substantially periodically supplied to the air pipe. The supply of purging air and the supply of cleaning air are synchronously performed such that purging air is supplied immediately before the supply of cleaning air, and the supply of an electric current to the heater is performed by cyclically repeating a current supply for a first predetermined period of time and a stop of current supply for a second predetermined period of time. The supply of electric current to the heater is stopped during the supply of cleaning air and the supply of purging air.

In the particulate incinerating mechanism according to the present invention, the hopper has a bottom made of a heat-insulating material. The bottom of the hopper has an elongate deep bottom portion and slant portions sloping upward from the deep bottom portion. The hopper further has an air pipe having a large number of small holes and extending along the deep bottom portion, and a heater extending above the air pipe in parallel to it. The small holes of the air pipe are formed such that air can be jetted out from the small holes toward the heater. The air pipe is connected to an air supply source so as to be able to supply a relatively small quantity of burning assist air and a relatively large quantity of purging air. The heater is supplied with an electric current through a current controller. The current controller is arranged to cyclically repeat a supply of electric current to the heater and a stop of current supply to the heater. Upon reception of a signal to open a solenoid valve for supplying cleaning air or a signal to open a solenoid valve for supplying purging air, the supply of electric current to the heater is stopped for a predetermined period of time.

DETAILED DESCRIPTION OF THE PREFERRED EMBODIMENTS

Figure 1:
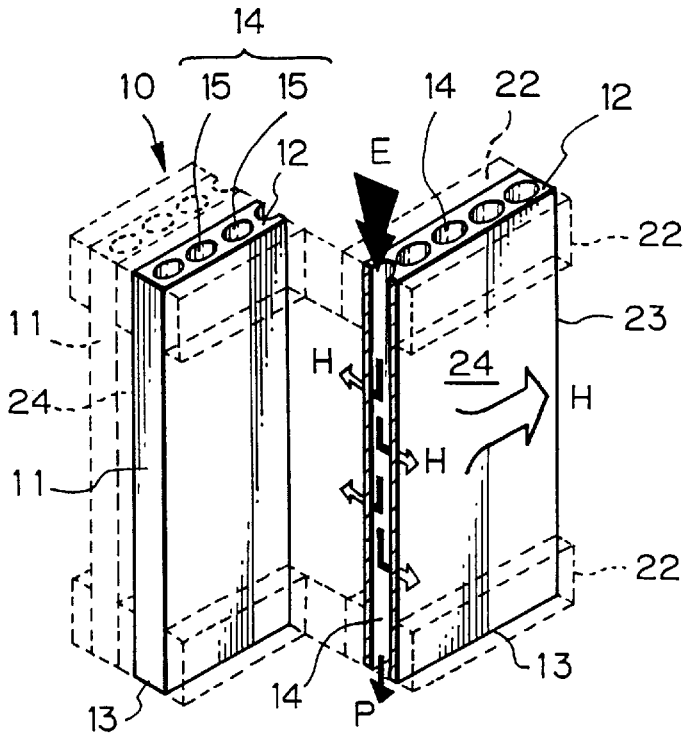
Fig. 1 PRIOR ART
FIG. 1 is a schematic view for describing the principle of a cross-flow filter.
Figure 2:
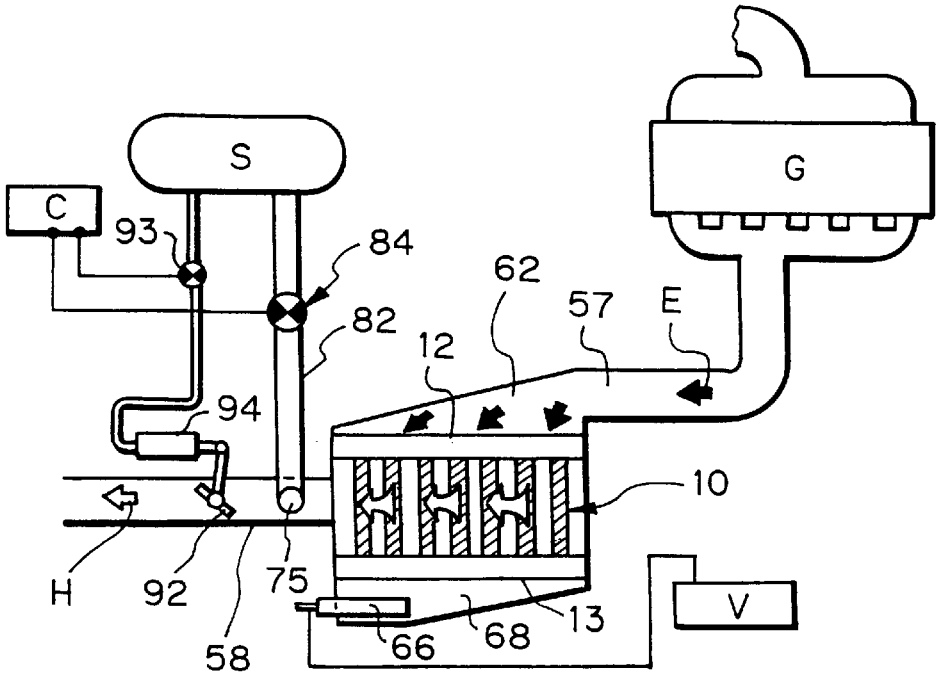
Fig. 2 PRIOR ART
FIG. 2 is a plan view schematically showing a conventional exhaust black smoke removing system.
Figure 3:
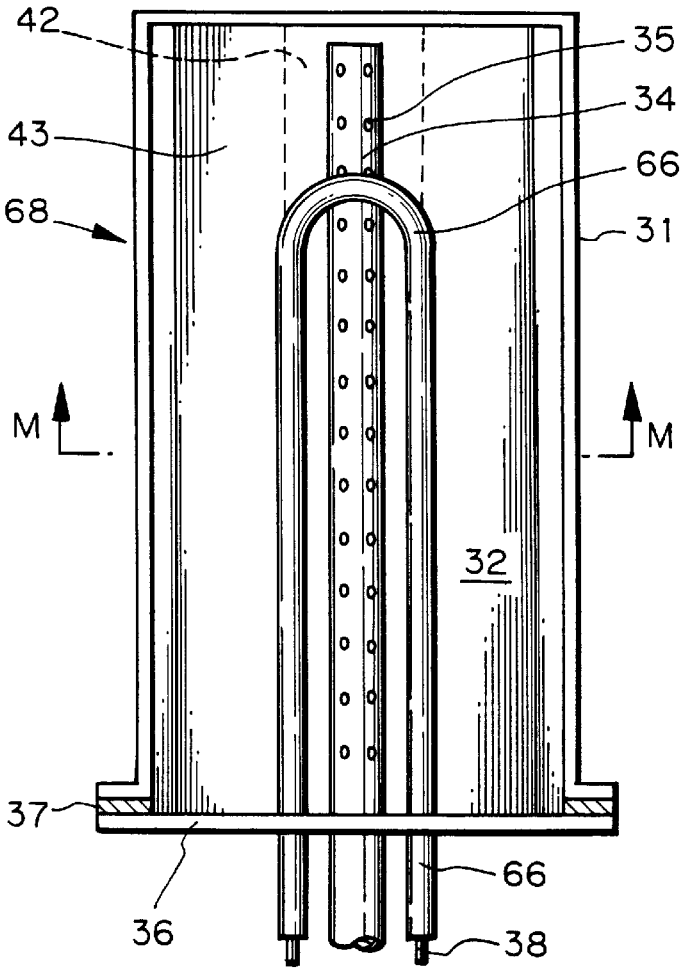
FIG. 3 is a plan view schematically showing a particulate incinerating mechanism for an exhaust black smoke removing system according to an embodiment of the present invention.
Figure 4:
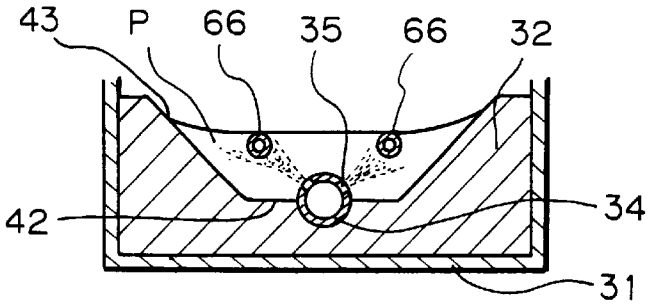
FIG. 4 is a sectional view taken along the line M—M in FIG. 3.

The present invention will be described below in detail with reference to FIGS. 3 to 6. FIG. 3 is a plan view schematically showing a particulate incinerating mechanism for an exhaust black smoke removing system according to an embodiment of the present invention. FIG. 4 is a sectional view taken along the line M—M in FIG. 3. A hopper 68 shown in FIGS. 3 and 4 is incorporated in an exhaust black smoke removing system as shown in FIG. 2. As shown in FIG. 4, the hopper 68 has a bottom made of a heat-insulating material 32. The bottom of the hopper 68 has an elongate deep bottom portion 42 and slant portions 43 sloping upward from the deep bottom portion 42. An air pipe 34 having a large number of small holes 35 extends substantially along the deep bottom portion 42. A tubular heater 66 extends above the air pipe 34 in parallel to it. The small holes 35 of the air pipe 34 have a diameter of 1 mm to 3 mm. The small holes 35 are so formed as to be able to jet out air toward the tubular heater 66.

The heater 66 is a U-shaped sheathed heater disposed parallel to the deep bottom portion 42 of the hopper 68 and supplied with an electric current from terminals 38. During operation, the heater 66 is buried in particulates P, and all heat generated is transmitted to the particulates P, thereby minimizing the power consumption of the heater 66. The heater 66 is supported by a flange 36 and detachably connected, together with the flange 36, to a hopper frame 31 through a gasket 37 by screws or the like, thereby enabling the heater 66 to be readily replaced.

Figure 5:
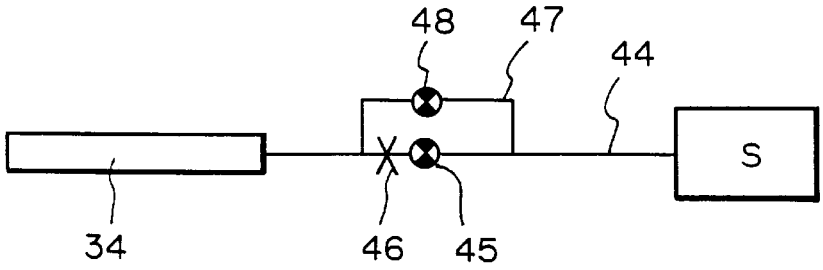
FIG. 5 is a layout drawing showing an air supply system according to an embodiment of the present invention.

A relatively small quantity of particulate burning assist air is always supplied into the hopper 68 from the large number of small holes 35 of the air pipe 34 by an air supply system as shown in FIG. 5. Moreover, a relatively large quantity of air is periodically supplied into the hopper 68 by the air supply system. Burning assist air is supplied from an air tank S to the air pipe 34 through a piping 44, a first solenoid valve 45, and an orifice 46. The total quantity of air supplied per minute is 1 to 3 liters. In addition, a relatively large quantity of purging air is periodically supplied into the air pipe 34 from the air tank S through the piping 44, a branch pipe 47, and a second solenoid valve 48.

The small holes 35 of the air pipe 34 are provided in two rows on the air pipe 34 so as to spray air on two longitudinal portions of the U-shaped heater 66 which extend parallel to the air pipe 34. A relatively small quantity of burning assist air is always supplied toward the heater 66. Purging air is sprayed on the heater 66 from each of the two rows of small holes 35 of the air pipe 34 to prevent overheating of the heater 66. Further, purging air blows burning particulates away from around the heater 66 to prevent overheating of the heater 66. Burning assist air supplied at all times is small in quantity; therefore, soot or the like tends to enter the small holes 35, causing the holes 35 to clog. However, such clogging can be prevented by periodically supplying purging air. Further, purging air blows not only burning particulates but also ash away from around the heater 66, thereby improving the heater efficiency and also promoting combustion.

Figure 6:
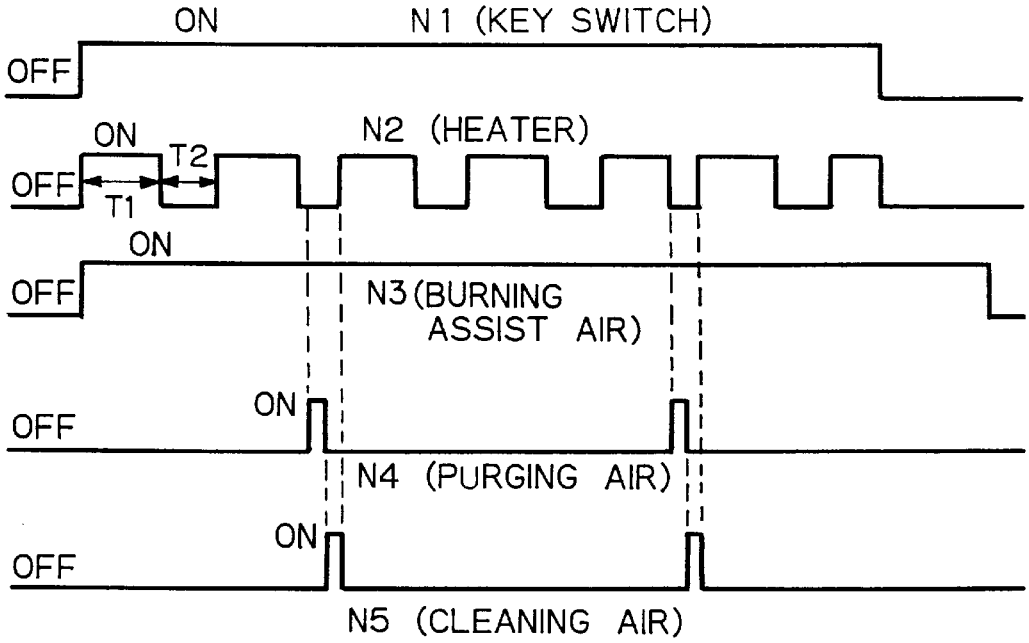
FIG. 6 is a timing chart of current control and air supply control according to an embodiment of the present invention.

FIG. 6 is a timing chart of current control and air supply control according to an embodiment of the present invention. In FIG. 6, N1 shows an ON/OFF state of electric current supplied from a key switch of an engine, and N2 shows the way in which electric current supplied to the heater 66 is ON/OFF controlled. In N1 and N2, OFF expresses a cutoff state, and ON a supply state. N3 shows the way in which burning assist air is supplied from the air pipe 34 to the hopper 68 (i.e. ON/OFF control of the first solenoid valve 45 shown in FIG. 5). N4 shows the way in which purging air is supplied from the air pipe 34 to the hopper 68 (i.e. ON/OFF control of the second solenoid valve 48 shown in FIG. 5). N5 shows the way in which reverse cleaning air is supplied to the filter (i.e. ON/OFF control of the solenoid valve 84 shown in FIG. 2). In N3, N4 and N5, OFF expresses a stop state, and ON a supply state. As shown in N2, the electric current supplied to the heater 66 is controlled such that a supply state for time T1 and a cutoff state for time T2 are cyclically repeated. Even after the key switch has been turned OFF, the burning assist air is continuously supplied for, for example, several tens of minutes to continue combustion.

As shown in FIG. 6, purging air N4 and cleaning air N5 are synchronously supplied in such a manner that purging air is supplied (N4-ON) for, for example, several seconds immediately before the supply of cleaning air (N5-ON). Current supply N2 to the heater 66 is performed by cyclically repeating a current supply for a first predetermined time T1 and a stop of current supply for a second predetermined time T2. The supply of current to the heater 66 is stopped during the supply of cleaning air and the supply of purging air. The first predetermined time T1 is, for example, 3 minutes, and the second predetermined time T2 is, for example, 2 minutes. These periods of time are determined according to the heater specifications and a target temperature.

A process of supplying reverse cleaning air to the filter to remove particulates is carried out by detecting an optimal timing (when a proper quantity of particulates has been accumulated) by another circuit (controller C shown in FIG. 2). A current controller (not shown) for ON/OFF controlling the current supplied to the heater 66 is operated in response to a signal to open the solenoid valve for supplying cleaning air and a signal to open the solenoid valve for supplying purging air.

(Effect of the Invention)

According to the present invention, combustible particulates, which are removed from an exhaust black smoke removing filter and dropped into a hopper by a stream of reverse cleaning air and pressure waves, are collected in a hopper bottom formed from a heat-insulating material and heated to ignite by a heater extending along the hopper bottom. The particulates are burned under the supply of a small quantity of burning assist air from small holes of the air pipe. Therefore, it is possible to minimize electric power required to heat and ignite the removed particulates. The heater is disposed above the air pipe in parallel to it, and a small quantity of burning assist air is supplied toward the heater from a large number of small holes of the air pipe. Accordingly, the particulates collected in the hopper can be efficiently burned with a minimal amount of air.

According to the present invention, a small quantity of burning assist air is always supplied from the small holes of the air pipe, which are directed toward the heater, and a relatively large quantity of purging air is substantially periodically supplied from the small holes of the air pipe. Therefore, it is possible to prevent clogging of the small holes of the air pipe which might otherwise be caused by particulates entering the small holes while a small quantity of burning assist air is flowing. Moreover, purging air periodically blows burning particulates away from around the heater. Therefore, it is possible to prevent overheating of the heater.

According to the present invention, purging air is supplied immediately before the supply of cleaning air. Therefore, after ash around the heater has been blown away by purging air, particulates are dropped from the filter by cleaning air and effectively heated to ignite by the heater and burned without being interfered with by ash. Moreover, the supply of electric current to the heater is stopped during the supply of purging air and the supply of cleaning air. Accordingly, it is possible to minimize the generation of heat not useful for combustion and hence possible to save electric power.

According to the present invention, the heater is intermittently supplied with an electric current and substantially periodically cooled by purging air. Therefore, overheating is prevented, and the lifetime of the heater can be increased. The heater is arranged to be detachable together with a flange. This facilitates replacement and inspection.

Although the present invention has been described through specific terms, it should be noted here that the described embodiments are not necessarily exclusive and that various changes and modifications may be imparted thereto without departing from the scope of the invention which is limited solely by the appended claims.

What is claimed is:

1. A particulate incinerating method for use with an exhaust black smoke removing system of the type wherein a filter made of a gas-permeable porous material has a plurality of first passages extending from an inlet surface, and a plurality of second passages extending between the first passages and opening on an outlet surface, and wherein exhaust gas discharged from a diesel engine flows successively through the filter inlet surface, the first passages, the gas-permeable porous material lying between the first and second passages, the second passages, and the outlet surface, so that particulates in the exhaust gas are deposited on wall surfaces of the first passages, and wherein cleaning air is supplied to flow in a direction reverse to a flow direction of the exhaust gas, thereby removing the deposited particulates from the wall surfaces of the first passages and allowing the removed particulates to drop into a hopper where they are incinerated by heat from an electric heater for ignition, and thus regenerating the filter, said method including the steps of:

providing said hopper with a bottom made of a heat-insulating material;

placing an air pipe having a large number of small holes so as to extend substantially along said bottom and parallel and below said heater;

continuously supplying a relatively small quantity of particulate burning assist air to said air pipe and jetting said burning assist air through said small holes toward said heater;

and periodically supplying a relatively large quantity of purging air to said air pipe to purge said small holes of said air pipe and to blow ash and particulates away from said heater.

2. A particulate incinerating method according to claim 1, wherein the supply of purging air and the supply of cleaning air are synchronously performed such that purging air is supplied immediately before the supply of cleaning air, and the energization of said heater is performed by cyclically repeating a current supply for a first predetermined period of time and a stop of current supply for a second predetermined period of time, with the supply of electric current to said heater being stopped during the supply of cleaning air to said filter and the supply of purging air to said air pipe.

3. A particulate incinerating mechanism for an exhaust black smoke removing system of the type wherein a filter made of a gas-permeable porous material has a plurality of first passages extending parallel from an inlet surface, and a plurality of second passages extending between the first passages and opening on an outlet surface, and wherein exhaust gas flows successively through the filter inlet surface, the first passages, the gas-permeable porous material lying between the first and second passages, the second passages, and the outlet surface, so that particulates in the exhaust gas are deposited on wall surfaces of the first passages, and wherein cleaning air is supplied to flow in a direction reverse to a flow direction of the exhaust gas, thereby removing the deposited particulates from the wall surfaces of the first passages and allowing the removed particulates to drop into a hopper where they are incinerated by heat from a heater for ignition, and thus regenerating the filter, characterized in that:

said hopper has a bottom wall made of a heat-insulating material, an air pipe having a large number of small holes and extending along said bottom wall, and said heater extending above said air pipe in parallel to it, and wherein said small holes of said air pipe are formed such that air can be jetted out from said small holes toward said heater, and said air pipe is connected to an air supply source so as to be able to supply a relatively small quantity of burning assist air and a relatively large quantity of purging air.

4. A particulate incinerating mechanism according to claim 3, wherein said heater is supplied with an electric current through a current controller, said current controller being arranged to cyclically repeat a supply of electric current to said heater and a stop of current supply to said heater, and wherein, upon reception of a signal to open a solenoid valve for supplying cleaning air or a signal to open a solenoid valve for supplying purging air, the supply of electric current to said heater is stopped for a predetermined period of time.

* * * * *